US005634345A

United States Patent [19]

Alsenz

[11] Patent Number: 5,634,345

[45] Date of Patent: Jun. 3, 1997

[54] OIL MONITORING SYSTEM

[76] Inventor: Richard H. Alsenz, 1545 Industrial Dr., Missouri City, Tex. 77489

[21] Appl. No.: 467,604

[22] Filed: Jun. 6, 1995

[51] Int. Cl.[6] ..... F25B 43/02; F01C 21/04

[52] U.S. Cl. ..... 62/84; 62/193; 184/7.4; 418/84

[58] Field of Search ..... 62/193 F, 473, 62/510, 84 F; 184/7.4, 6.16; 418/84

[56] References Cited

U.S. PATENT DOCUMENTS

| | | | |
|---|---|---|---|
| 3,581,519 | 6/1971 | Garrett, Jr. | 62/84 X |
| 4,870,831 | 10/1989 | Kitamoto | 62/84 |
| 5,199,271 | 4/1993 | Ewer | 62/193 |
| 5,396,780 | 3/1995 | Bendtsen | 62/212 |

FOREIGN PATENT DOCUMENTS

| | | | |
|---|---|---|---|
| 0140557 | 5/1990 | Japan | 62/193 |

OTHER PUBLICATIONS

Dossat, Roy J., *Principles of Refrigeration*, 3rd Ed., Prentice Hall Career & Technology, Englewood Cliffs, NJ (1991), pp. 1–552.

*Primary Examiner*—William E. Wayner

*Attorney, Agent, or Firm*—David A. Rose; Conley, Rose & Tayon, PC

[57] ABSTRACT

An apparatus and method determines and controls the oil level in one or more refrigeration system compressors. The invention returns lubricating oil to the compressors to maintain oil levels sufficient for proper lubrication of each compressor, and also monitors the flow rate of oil returned to each individual compressor. A level sensor and a flow control device are connected to a control circuit to control the flow of lubricating oil returning to the compressors. The control circuit controls the return flow of oil as well as various other functions of the system, monitors compressor oil levels, and determines the rate oil is returned to each compressor. The method includes measuring system parameters, comparing measured oil levels to desired oil levels, and injecting lubricating oil into a compressor if the measured oil level is below the desired level. The amount of oil added is then calculated and the oil flow rate is measured.

16 Claims, 3 Drawing Sheets

OIL MONITORING SYSTEM

FIELD OF THE INVENTION

The present invention relates to compressors for refrigeration systems and more particularly to an apparatus and method for monitoring compressor crankcase oil levels and determining the mount of lubricating oil from the crankcases that is inadvertently discharged from the compressor with the compressed refrigerant ("pumped over").

BACKGROUND OF THE INVENTION

Refrigeration systems, such as used in supermarkets for cooling food storage fixtures, contain a compressor system having one or more compressors for compressing a refrigerant fluid. Refrigeration compressors must be lubricated for proper operation. Some amount of compressor lubricating oil inevitably is pumped over with the compressed refrigerant, circulates through the refrigeration system, and returns to the compressor crankcases. Oil is pumped over in both reciprocating and rotary compressors, due to blow-by of oil from the crankcase around the pistons in a reciprocating compressor or the vanes in a centrifugal compressor. As a compressor wears in service, clearances between moving parts increase, and greater amounts of oil are pumped over. As more oil is pumped over by a compressor, more oil must be added to its crankcase to maintain the oil level at its proper level. Excessive blow-by indicates compressor wear, and leads to excessive amounts of pumped over oil circulating in the refrigeration system. This adversely impacts refrigerating capacity and efficiency, and can reduce the compressor oil level below that necessary for adequate lubrication.

When multiple compressors are connected in parallel to a common suction line, the lubricating oil returning through the suction line will not evenly distribute itself among the several compressors. Further, the amount of oil pumped over by any one compressor will be different from that of the other compressors. It is therefore important to monitor the oil level of each individual compressor, and to maintain the crankcase oil level for each compressor within acceptable limits. Oil separators are typically placed in the common compressor discharge line. The separated oil is typically returned to a reservoir and then metered back to the compressors through individual float valves which detect a low compressor oil level. However, these systems do not measure the flow rate of oil added to the compressors.

Previous attempts to overcome these problems have included interconnecting the crankcases of multiple compressors so that the crankcase oil levels equalize. However, this response does not address the problem of ensuring adequate lubrication when oil levels fall below acceptable limits, such as may occur when large quantities of oil are pumped over due to compressor wear. Further, this solution cannot be used unless the pressures are equal in all the interconnected crankcases and the compressors are all at the same height on their foundations. The present invention overcomes the problems of the prior art.

SUMMARY OF THE INVENTION

The present invention includes an apparatus and method for oil level control in a refrigeration system. The apparatus includes one or more compressors in the refrigeration system for compressing a refrigerant. The compressors are lubricated by a lubricating oil, some of which is discharged from the compressors with the compressed refrigerant. A source of lubricating oil is provided for lubricating the compressors with at least one conduit connected to the compressors for supplying them with the lubricating oil. At least one sensor, which may be a compressor crankcase oil level sensor, is provided to determine the amount of lubricating oil in the compressors. At least one flow control device, which may be a control valve or a pulse modulated solenoid valve, is included for controlling the flow rate of the lubricating oil returned to the compressors. A control circuit, which may be a microprocessor, receiving electrical signals from the sensor and transmitting electrical signals to the flow control device, is also provided to regulate the flow control device.

The invention maintains compressor oil levels acceptable for proper lubrication of each compressor, and monitors individual compressor oil consumption. The invention also provides a control circuit, which may be a microprocessor, to control various functions of the refrigeration system, including monitoring the lubricating oil levels in the compressor crankcases and the quantity of oil pumped over from the compressor crankcases to the compressed refrigerant discharged from each compressor.

The present invention also provides a method to monitor compressor oil consumption and control compressor oil levels. The method consists of first, measuring system parameters including compressor oil levels, oil supply pressure, and refrigerant pressure. The measured oil levels are then compared to desired oil levels, and lubricating oil is returned to a compressor if the measured oil level is below the desired level. The amount of oil added is then calculated and the oil flow rate determined. The monitoring of the duty cycle and, for example, knowledge of the solenoid valve orifice size allows determination of the amount of oil returned to a compressor over a period of time. The amount of oil pumped over by each compressor is equal to the amount of oil added to maintain the oil level constant in each compressor. By monitoring the amount of oil added, the invention allows determination of the amount of oil pumped over by each compressor and provides a determination of the state of wear of a compressor. Further, in a multiple compressor system, the relative condition of each of the compressors is determined. By repeating this determination continuously, the oil consumption of each compressor can be monitored over time. Deterioration in compressor condition can be ascertained from an increase in oil consumption. The invention thus improves the reliability of refrigeration compressors and systems and allows determination of the state of compressor wear and comparison of the condition of multiple compressors.

Examples of the more important features of the invention have thus been summarized rather broadly in order that the detailed description thereof that follows may be better understood, and in order that the contributions to the art may be better appreciated. There are, of course, additional features of the invention that will be described hereinafter and which will form the subject of the claims appended thereto. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
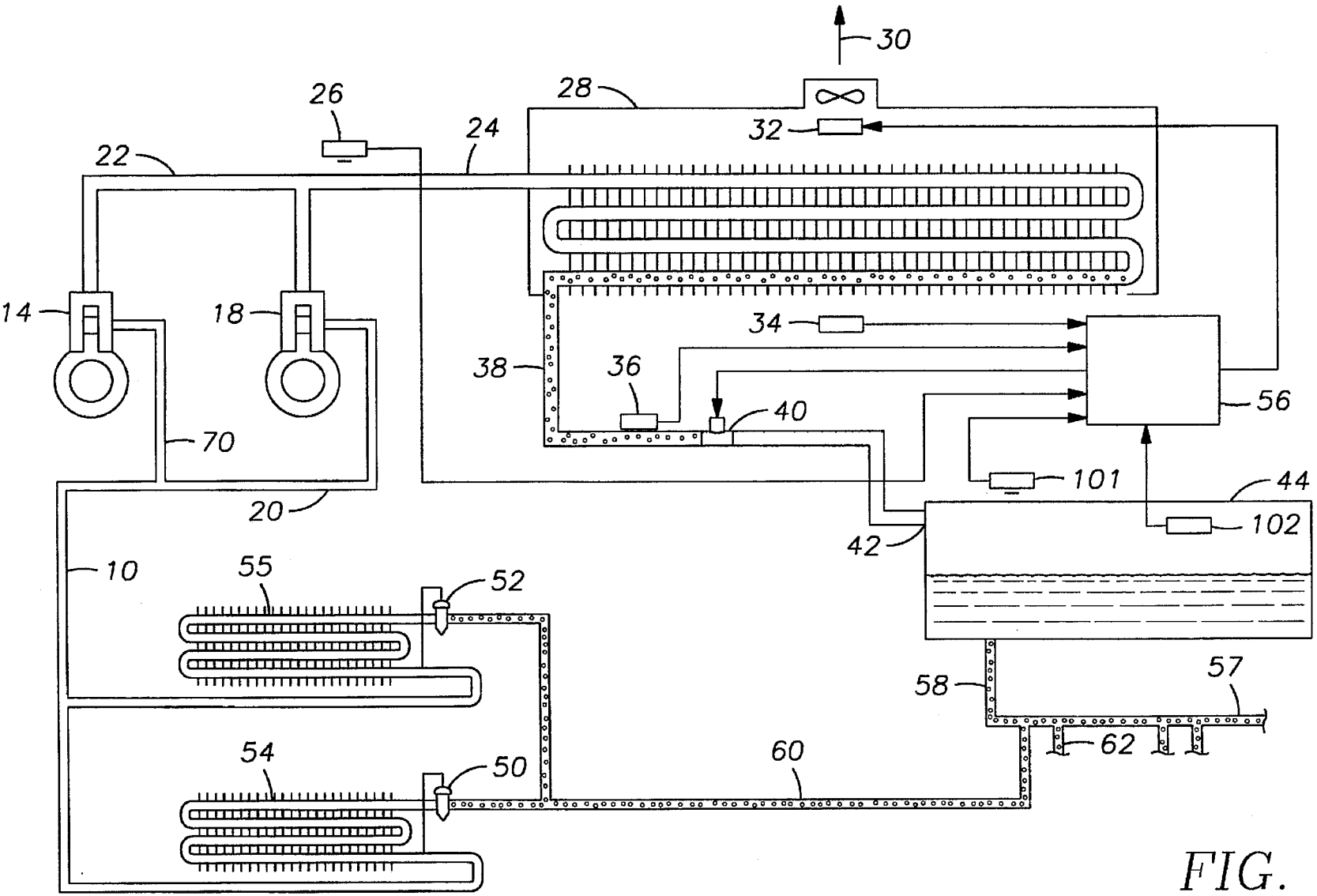
FIG. 1 depicts a typical refrigeration system which utilizes two parallel compressors, a condenser with a liquid control valve, a liquid receiver, and two parallel evaporators.

Referring initially to FIG. 1, a refrigeration system for use with the present invention is shown. The refrigeration system depicted therein is a closed loop, commonly connected, multiple-stage refrigeration system. The system includes at least one compressor 14, 18, at least one condenser 28, at least one evaporator 54, 55 with an expansion device 50, 52, at least one cooling fan 32, a reservoir 44 for holding liquid refrigerant, a temperature sensor 36 at the condenser outlet to measure the temperature of the liquid refrigerant, and a microcontroller circuit 56 containing a microprocessor (not shown) to control various functions of the refrigeration system. The control functions of the refrigeration system and the control functions of the oil monitoring system of the present invention are preferably performed by a single microcontroller circuit. As will be clear to one skilled in the art, the oil monitoring system of the present invention may be utilized in many other types of refrigeration systems without departing from the scope of the present invention.

In operation, a vapor refrigerant at a low pressure is passed into parallel compressors 14 and 18 via a refrigerant suction line 11. The compressors 14 and 18 compress the refrigerant to a high pressure gaseous state and discharge it through refrigerant lines 22 and 24 which communicate with the condenser 28. A high pressure transducer 26 is installed in the refrigerant line 24, which provides an electrical signal to a microcontroller circuit 56, that is representative of the pressure of gas in line 24.

The condensed refrigerant leaves the condenser 28 through liquid line 38 as a liquid. A temperature sensor 36 is installed on liquid line 38 to measure the temperature of the liquid refrigerant and provides a corresponding signal to the microcontroller circuit 56. Refrigerant is discharged from liquid line 38 through outlet 42 into fluid reservoir 44. The liquid leaves the reservoir 44 through line 58 and enters a manifold system 57 and then a liquid line 60 that is connected to expansion valves 50 and 52. Each expansion valve 50 and 52 is connected to separate parallel evaporators 54 and 55, respectively. Although this embodiment of the present invention is described with respect to two expansion valves 50, 52 and two parallel evaporators 54, 55, it should be understood that the invention is equally applicable to refrigeration systems employing any number of expansion valves or other refrigerant expansion means, and any number of evaporators.

The two parallel evaporators 54, 55 form a single refrigeration system wherein the expansion valves 50 and 52 meter the liquid refrigerant into evaporators 54 and 55, respectively. Similarly, other refrigeration systems (not shown) may be connected to the liquid manifold system 57 via lines 62 and the like. When the liquid refrigerant is metered through the expansion valves 50 or 52, it evaporates into a gaseous state within its respective evaporator at a low pressure and a low temperature. The evaporation of the refrigerant into a gaseous state is such that heat is removed from the evaporator surroundings, refrigerating them to produce a refrigerated space. The vapor refrigerant is then passed to the compressors 14 and 18 through the suction line 11, which completes a refrigeration cycle that is continuously repeated during operation.

Figure 2:
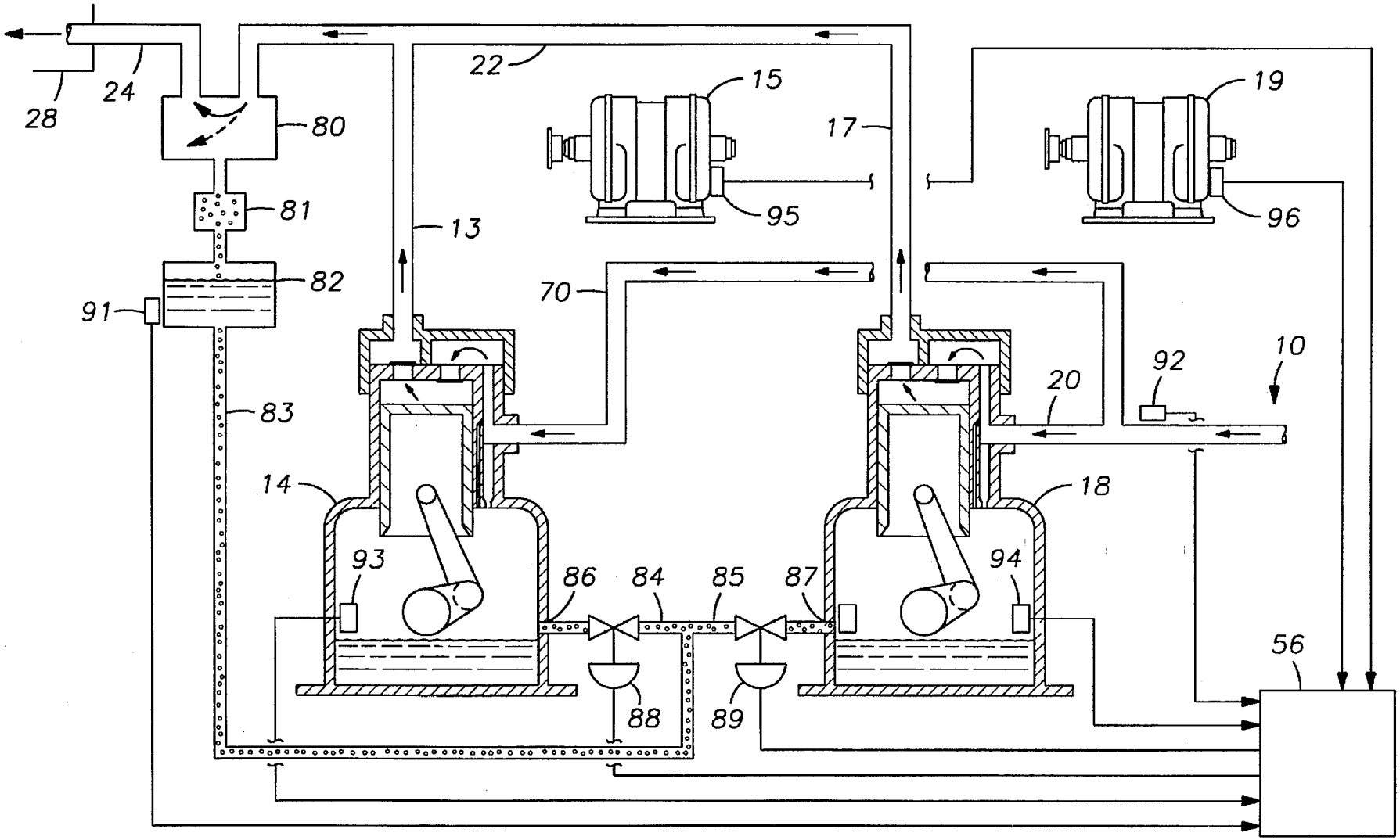
FIG. 2 shows a simplified schematic of a portion of a typical refrigeration system, with the oil monitoring system of the present invention installed on its compressors.

Referring now to FIG. 2, a portion of a typical refrigeration system is shown with the oil monitoring system 10 of the present invention installed on parallel compressors 14, 18. The oil monitoring system 10 includes an oil separator 80, in compressor discharge line 22, which separates compressed refrigerant vapor from the lubricating oil which is pumped over with the refrigerant. The lubricating oil separated from the compressed refrigerant vapor by oil separator 80 is collected in oil reservoir 82. The oil pressure in oil reservoir 82 may be held relatively constant by pressure regulator 81, disposed between oil separator 80 and oil reservoir 82.

Crankcase oil level sensors 93, 94, preferably disposed within the crankcases of compressors 14, 18 respectively, are electrically connected to microcontroller circuit 56, and enable maintenance of crankcase oil at levels sufficient for satisfactory operation of compressors 14, 18. Oil level sensors 93, 94 preferably provide signals to microcontroller circuit 56 when the respective oil levels fall below their predetermined levels. Alternatively, oil level sensors 93, 94 continuously provide signals representative of the crankcase oil levels in compressors 14, 18 to microcontroller circuit 56. In any case, the signals from oil level sensors 93, 94 may be used by microcontroller circuit 56 to determine whether oil levels are sufficient for satisfactory compressor operation.

Solenoid operated valves 88, 89 communicate with oil reservoir 82 via main oil line 83 and oil lines 84, 85. Flow measuring transducers 101, 102, 103 may be placed either in oil lines 84 and 85, or in oil line 83 to measure the flow rate of lubricating oil. Oil reservoir 82 thus supplies lubricating oil to solenoid operated valves 88, 89 at a pressure that may be governed by pressure regulator 81, which is preset at a desired pressure level. Oil pressure sensor 91 is electrically connected to microcontroller circuit 56 and provides a signal representative of the oil supply pressure in oil lines 83, 84, 85. A pressure sensor 92 is provided in suction line 11 and is also electrically connected to microcontroller circuit 56 to provide a signal representative of the refrigerant pressure in suction line 11. The pressure within the crankcase of each of the parallel compressors 14, 18 will generally be substantially the same as the pressure in suction line 11. Thus the signal from suction line pressure sensor 92 is used to measure crankcase pressure. In a refrigeration system employing multiple stages of compressors in series, where the crankcase pressures vary between stages of compressors, suction line pressure sensors may be provided for each stage or each compressor. As one skilled in the art will immediately realize, many other compressor configurations can be used successfully with the oil monitoring system herein described without departing from the scope of this invention.

Motor operation sensors 95, 96, preferably disposed near the drive motors 15, 19 driving compressors 14, 18 respectively, each provide a signal to microcontroller circuit 56 indicating whether its respective drive motor is operating its associated compressor. Motor operation sensors 95, 96 thus allow microcontroller circuit 56 to determine the time of operation for each of the compressors 14, 18 individually.

The microcontroller circuit 56 preferably contains, among other things, a microprocessor, a timer, analog to digital converters, switching circuitry, memory elements, and other electronic circuitry which enables it to access information from various sensors used in the oil monitoring and refrigeration systems, to process these signals, and to control a variety of functions of these systems. Among the functions controlled by the microcontroller circuit 56 are the monitoring of compressor crankcase lubricating oil levels, controlling the addition of oil to compressor crankcases so as to maintain the oil level substantially constant, measuring the flow rate of oil via flow measuring devices if such devices are used, calculating the quantity of oil added to each compressor crankcase, and determining the rate at which oil is pumped over by each compressor. The use of circuits containing microprocessors and circuits containing discrete electronic components to control the operation of refrigeration systems is known in the electrical engineering and microprocessor art, and is therefore not described in greater detail here.

The microcontroller circuit 56 is operatively coupled to each of sensors and thus receives electrical signals from the crankcase oil level sensors 94, 94, the oil pressure sensor 91, the refrigerant suction line pressure sensor 92, the compressor motor operation sensors 95, 96, high pressure transducer 26, liquid line temperature sensor 36, temperature sensors 34, 36, and flow measuring transducers 101, 102, 103 on oil lines 83, 84, 85, if such transducers are used. The microcontroller circuit 56 is also coupled to the solenoid operated control valves 88, 89, for controlling the return of lubricating oil to the compressor crankcases, and controlling refrigeration system elements, such as compressor motors 15, 19, liquid valve 40, and fan 32 for controlling operation of the refrigeration system. The microcontroller circuit 56 receives signals from the various sensors in the oil monitoring and refrigeration systems and in response thereto, and in accordance with programmed instructions, controls the operation of the various system elements.

Referring again to FIG. 2, the normal operation of compressors 14, 18 is such that a small amount of lubricating oil passes between the compressor piston and cylinder walls, and is carded out of the compressors with the compressed refrigerant vapor (i.e. "pumped out") and discharged with the refrigerant vapor into lines 13 and 17. The lubricating oil that is thus pumped out is entrained by the discharged refrigerant vapor through refrigerant discharge line 22 and into oil separator 80. Oil separator 80 may be an impingement type separator, well known in the art, which separates the entrained lubricating oil from the discharged refrigerant vapor. As will be obvious to one skilled in the art, oil separator 80 may be any of a number of types of oil-refrigerant vapor separators depending on the design of the refrigeration system, the particular type of refrigerant used in the refrigeration system, and economic and other considerations. The present invention is intended to apply to all types of oil-refrigerant separators.

Oil separator 80 separates the fluid flowing through compressor discharge line 22 into a fluid which is substantially all refrigerant, which discharges from oil separator 80 into refrigerant line 24, and a fluid which is substantially all lubricating oil, which is discharged from oil separator 80 through optional oil pressure regulator 81 and into oil reservoir 82. The oil pressure in oil reservoir 82 may be maintained substantially constant by oil pressure regulator 81. Oil pressure sensor 91, which is electrically connected to microcontroller circuit 56, senses the oil pressure in oil lines 84, 85 and communicates an electrical signal representative thereof to microcontroller circuit 56.

Oil reservoir 82 supplies lubricating oil to solenoid operated control valves 88 and 89 via main oil supply line 83 and branch oil supply lines 84 and 85, respectively. The flow of lubricating oil from oil reservoir 82 is through main oil line 83 to branch oil supply lines 84 and 85, through solenoid operated control valves 88 and 89, and finally through oil discharge lines 86 and 87 which discharge lubricating oil back to the crankcases of compressor 14 and 18. The flow of lubricating oil into the crankcase of compressor 14, as described above, takes place only when solenoid operated control valve 88 is actuated to its open position by microcontroller circuit 56. Similarly, the flow of lubricating oil into the crankcase of compressor 18 takes place only when solenoid operated control valve 89 is actuated to its open position by microcontroller circuit 56.

Figure 3:
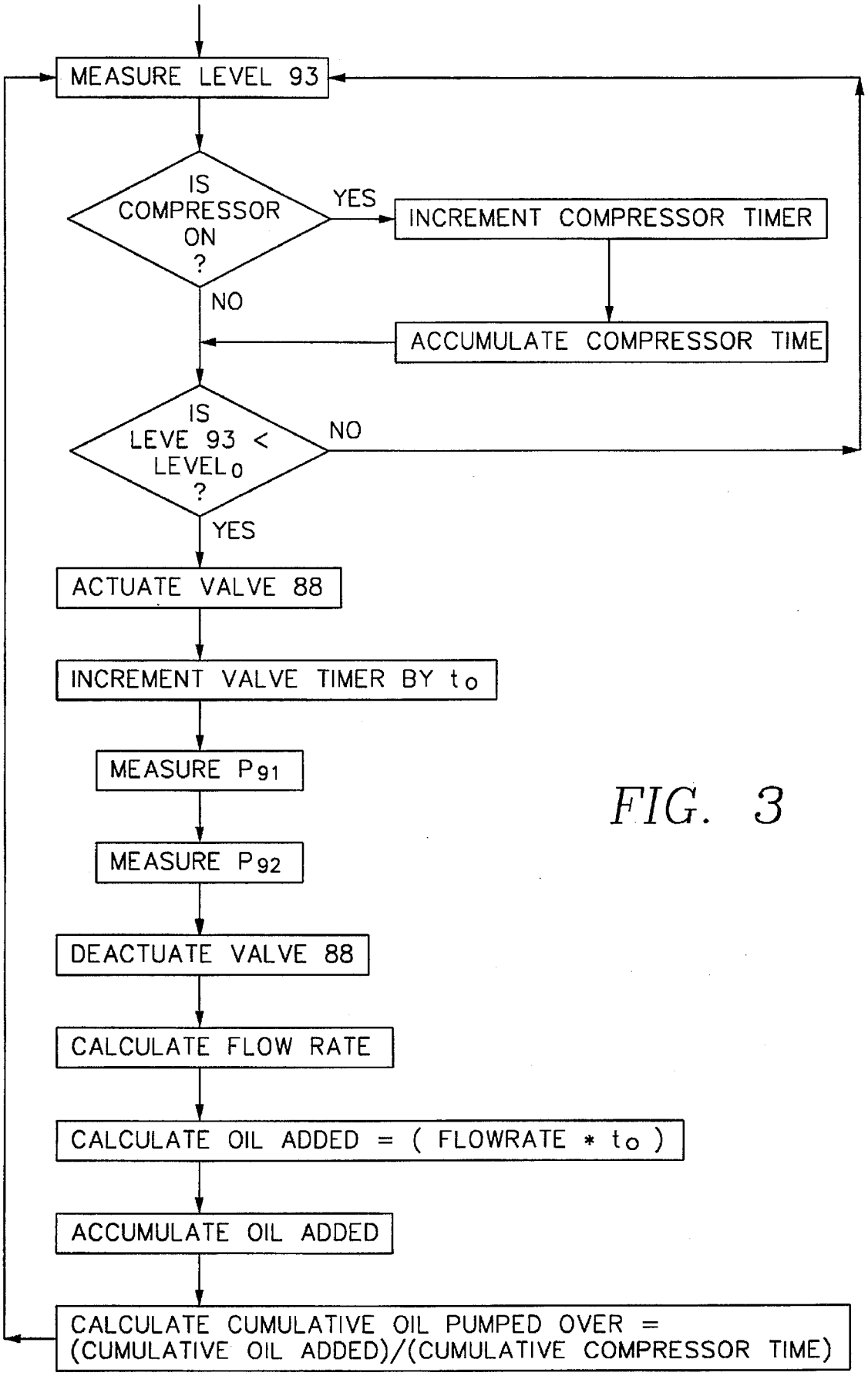
FIG. 3 is a logic flow diagram illustrating a control method of the present invention.

Compressor crankcase oil level sensors 93 and 94 preferably continuously sense the crankcase oil levels of compressors 14 and 18, respectively, and provide signals representative thereof to microcontroller circuit 56. When the crankcase oil level of compressor 14 falls below a predetermined level or, alternatively, falls below a predetermined level by a specified amount, in accordance with the programming operated by a microprocessor within microcontroller circuit 56, solenoid operated control valve 88 is actuated to its open position. Similarly, when the crankcase oil level of compressor 18 falls below a predetermined level or, alternatively, falls below a predetermined level by a specified amount, in accordance with the programming operated by a microprocessor within microcontroller circuit 56, solenoid operated control valve 89 is actuated to its open position. The operation of microcontroller 56 in this application is further illustrated by reference to the flow diagram of FIG. 3. Although described with respect to only two compressors, it should be understood that any number of compressors may thus be included in the oil monitoring system of the present invention. Each of the multiple compressors to be monitored is preferably provided with a separate solenoid operated control valve, such as control valves 88 and 89.

Solenoid operated control valves 88 and 89, when actuated to the open position, may remain open for a predetermined period of time, or the actual time a valve 88 or 89 is open may be measured by a timer (not shown) or a timer circuit within microcontroller circuit 56. In the case of a timer circuit within microcontroller circuit 56, a control valve 88 or 89 may remain actuated to the open position until the signal communicated to microcontroller circuit 56 from crankcase oil level sensor 93 or 94 indicates that the crankcase oil level in compressor 14 or 18 has returned to its predetermined desired level. In any event, the time period during which a control valve 88, 89 is open is measured or determined by microcontroller circuit 56. Solenoid operated control valves 88 and 89 are deactuated to the closed position upon a signal from microcontroller 56 that occurs either on the expiration of a discrete predetermined time period, or on the indication to microcontroller 56 from the respective oil level sensor 93, 94, that the crankcase oil level has returned to its desired level.

The oil pressure is continuously monitored by oil pressure sensor 91 and microcontroller circuit 56. Similarly, either the refrigerant suction line pressure or the compressor crankcase pressure are continuously monitored by suction line pressure sensor 92 or a crankcase pressure sensor (not shown) and microcontroller 56. The pressure of either the refrigerant suction line or the compressor crankcase may be sensed, because in most parallel multiple compressor refrigeration systems these pressures will be substantially the same.

The diameters of the orifices in solenoid operated control valves 88, 89, through which lubricating oil passes when a control valve is actuated, are known prior to installation in the oil monitoring system of the present invention. Therefore, because the time period that a control valve is actuated to the open position, the oil pressure upstream of the control valves (via oil pressure sensor 91), and the oil pressure downstream of the control valves (via suction line pressure sensor 92) are also known or determined by microcontroller circuit 56, using methods well known in the art the amount of lubricating oil passing through any control valve and into any compressor crankcase is readily determined over any particular period of time.

Alternatively, flow measuring transducers 101, 102, 103 disposed in oil line 83, or in oil lines 84 and 85, transmit signals, representative of the amount of lubricating oil returned to the compressor, to microcontroller circuit 56. In this case, the diameters of the solenoid operated control valves 88, 89, the time valves 88 and 89 are open, and the oil pressures need not be known. The signal transmitted to microcontroller circuit 56 is itself indicative of the oil flow. The oil flow rate is calculated by microcontroller circuit 56 by dividing the oil flow rate by the time valves 88, 89 are open.

Once the amount of lubricating oil added over a period of time to each of the crankcases of compressors 14, 18 is determined, the cumulative amount of oil added to the crankcases of each of the compressors 14, 18 is easily determined by cumulating the signals in microcontroller circuit 56. The flow rate of oil can also be readily computed by dividing the amount of oil added by the time period over which the oil was added.

Compressor operation sensors 95 and 96 preferably continuously monitor the operation of compressor motors 15 and 19, respectively, and communicate signals to microcontroller 56 when motors 15, 19 are operating compressors 14, 18. These signals, in association with the timer circuit of microcontroller 56, allow determination of the operating time of compressors 14, 18. Once the amount of lubricating oil added to each compressor and the operating time of each compressor is determined, the flow rate of lubricating oil addition is readily determined by microcontroller circuit 56, using methods well known in the art to divide the quantity of oil added by the compressor operating time. The rate of oil addition required to maintain the compressor crankcase oil level constant is equivalent to the rate at which oil is pumped over by that compressor. Thus the oil monitoring system of the present invention provides for the determination of the rate oil is pumped over in each compressor of a refrigeration system.

To summarize with respect to compressor 14, the time that control valve 88 is open is determined by microcontroller circuit 56 using means well known in the art. Using the orifice size of control valve 88 and the upstream and downstream pressures as determined by microcontroller 56 from sensors 91 and 92 respectively, with the physical properties of the lubricating oil, the lubricating oil flow into the crankcase of compressor 14 is determined by microcontroller circuit 56. The operating time of compressor 14 is determined by microcontroller 56 from motor operation sensor 95. The oil injection rate, and therefore the oil consumption rate or rate oil is replenished, is then determined by microcontroller 56 by dividing the quantity of oil injected by the operating time.

Comparison of the lubricating oil injection rate for each compressor allows a comparison of the amount of oil pumped over by each compressor. The continuous monitoring of the oil consumption rates described above provides a means to determine the relative state of wear of any particular compressor, and further provides means to determine the condition of refrigeration compressors and compressor components. For example, if compressor 14 is pumping over lubricating oil at a flow rate of 1 liter per day and compressor 18 is pumping over lubricating oil at a flow rate of 2 liters per day, it indicates that compressor 18 has a problem. This information can be used by microcontroller circuit 56 to sound an alarm (not shown) or call out via a modem (not shown) to notify service personnel of an impending problem. Also, the flow rate of lubricating oil to each compressor can be compared to a standard flow rate, determined from testing or experience, to determine the condition of an individual compressor. The present invention thus provides a substantial savings in the operation and maintenance costs of refrigeration systems relative to the current state of the art, and is indicative of a development which will be welcomed by the refrigeration field.

The above described embodiment of the oil monitoring system of the present invention thus provides the benefits of monitoring the oil consumption for each compressor of any refrigeration system, with the additional advantages of monitoring the relative oil consumption performance of compressors, indicating relative wear and maintenance conditions, indicating the total amount of oil pumped over in a multiple compressor refrigeration system, providing a means to track the relative performance of compressors in a multiple compressor refrigeration system, and providing a means to track the maintenance condition of compressors in a multiple compressor refrigeration system.

While the invention has been described in accordance with reciprocating compressors, one experienced in the art may easily apply the invention to other types of compressors. These embodiments have not been specifically described because they are considered redundant in application of the invention in view of the above description. As would be obvious to one skilled in the art, many other applications of the present invention are possible and the description provided herein is intended to be limited only by the claims appended hereto.

We claim:

1. A system for providing and measuring lubricating oil to a compressor compressing a refrigerant, comprising:

a source of lubricating oil;

a flow control associated with the compressor for controlling the flow of the lubricating oil to the compressor independently of the flow of the refrigerant;

a flow measuring device for measuring the flow rate of lubricating oil returned to the compressor;

a sensor on the compressor for determining the amount of lubricating oil in the compressor.

2. The system of claim 1, in which said flow control member comprises a pulse modulated solenoid valve.

3. The system of claim 1, in which said sensor comprises a level sensor for determining the oil level in the compressor crankcase.

4. The system of claim 1, in which said source comprises an oil separator connected to an outlet of the compressor for separating oil from the compressed refrigerant.

5. The system of claim 4, further comprising an oil reservoir connected between said oil separator and the flow control.

6. The system of claim 1, further comprising a flow measuring transducer for measuring the mount of the flow of lubricating oil into the compressor.

7. The system of claim 6, wherein said flow measuring transducer is electrically connected to a control member and provides electrical signals to said control member representative of the flow rate of lubricating oil to the compressor.

8. The system of claim 1, further including a control member which monitors the amount of time that said flow control allows the flow of lubricating oil to the compressor.

9. The system of claim 1, wherein said flow control includes a solenoid for opening and closing said flow control.

10. A system for providing and measuring lubricating oil to a compressor compressing a refrigerant, comprising:

a source of lubricating oil;

a flow control associated with the compressor for controlling the flow of the lubricating oil to the compressor, said flow control member comprising a pulse modulated solenoid valve;

a flow measuring device for measuring the flow rate of lubricating oil returned to the compressor;

a sensor on the compressor for determining the amount of lubricating oil in the compressor, said sensor comprising a level sensor for determining the oil level in the compressor crankcase;

a control member electrically connected to said flow control member and receiving electrical signals from said sensor for controlling the flow of lubricating oil into the compressor.

11. A system for monitoring consumption of lubricating oil by a compressor compressing a refrigerant, comprising:

a compressor suction inlet;

a source of lubricating oil;

a conduit connecting said source to the compressor for providing lubricating oil to the compressor;

a control valve having a known capacity, said control valve disposed in said conduit for controlling the flow of lubricating oil to the compressor;

a first pressure sensor disposed in the conduit for producing an electrical signal representative of the oil pressure in said conduit upstream of the control valve;

a second pressure sensor disposed near the compressor suction inlet for producing an electrical signal representative of the oil pressure downstream of the control valve;

a first control circuit in electrical connection with the first and second pressure sensors to measure the flow rate of lubricating oil through the control valve during the time which the control valve is actuated to an open position.

12. The system of claim 11, further comprising a second control circuit having a timer, said control circuit in electrical connection with the control valve to measure the time the control valve is actuated to the open position.

13. The system of claim 12, further comprising:

a compressor motor;

a compressor motor operation sensor disposed near the compressor motor, said compressor motor operation sensor producing an electrical signal when the compressor motor is energized;

a third control circuit having a timer, said control circuit in electrical connection with the compressor motor operation sensor to measure the time the compressor motor is in operation.

14. The system of claim 13, in which said first, second, and third control circuits comprise a microprocessor to calculate the mount of lubricating oil added to the compressor per unit of time the compressor motor is in operation.

15. A method of controlling oil level in a refrigeration compressor, comprising the steps of:

collecting lubricating oil discharged from a compressor;

monitoring the compressor oil level;

returning collected oil to a compressor when the compressor oil level is low;

measuring the rate at which lubricating oil is returned to the compressor.

16. A method of monitoring refrigeration compressor oil consumption and controlling refrigeration compressor oil level comprising the steps of:

measuring the compressor oil level;

comparing the measured oil level to a setpoint oil level;

pulsing a valve, with a known orifice diameter, open to add oil to the compressor if the measured oil level is below the setpoint oil level by a predetermined amount;

measuring the time of each pulse during which the valve is open;

measuring the time during which the compressor is in operation;

measuring the oil pressure upstream of the valve during each time period it is open;

measuring the oil pressure downstream of the valve during each time period it is open;

calculating the flow rate of oil over each time period the valve is open from the measured pressures upstream and downstream of the valve and the known valve orifice diameter;

calculating the amount of oil added during each time period the valve is open by multiplying the flow rate of oil over each time period by the length of each time period;

cumulating the quantity of oil added to the compressor by summing the amount of oil added during each subsequent time period the valve is open;

cumulating the time the compressor is in operation;

calculating the rate at which oil is pumped over by dividing the cumulated quantity of oil added by the cumulated time of compressor operation.

* * * * *